US007124986B1

(12) United States Patent
Bailey

(10) Patent No.: US 7,124,986 B1
(45) Date of Patent: Oct. 24, 2006

(54) PROTECTIVE COVERS FOR LEGS OF TABLES AND CHAIRS

(75) Inventor: David M. Bailey, 30 Brooklawn Ave., Norwalk, CT (US) 06854

(73) Assignee: David M. Bailey, Norwalk, CT (US)

( * ) Notice: Subject to any disclaimer, the term of this patent is extended or adjusted under 35 U.S.C. 154(b) by 0 days.

(21) Appl. No.: 10/877,481

(22) Filed: Jun. 28, 2004

(51) Int. Cl.
*A47B 91/12* (2006.01)

(52) U.S. Cl. ..... 248/188.9; 16/42 R; 16/42 T

(58) Field of Classification Search ..... 247/463.1, 247/463.2; 248/188.8, 188.9, 345.1; 16/18 CG, 16/42 R, 42 T
See application file for complete search history.

(56) References Cited

U.S. PATENT DOCUMENTS 1,849,836 A * 3/1932 Jantzen et al. ..... 248/188.9
1,921,561 A * 8/1933 Christmas ..... 248/188.9
2,103,095 A * 12/1937 Schermerhorn ..... 248/188.9
2,301,420 A * 11/1942 Liabastre ..... 248/188.9
D166,618 S * 4/1952 Mince ..... D6/610
4,700,430 A * 10/1987 Raftery ..... 16/18 CG
4,923,158 A * 5/1990 Saisho ..... 248/188.8
5,173,990 A * 12/1992 Owen ..... 248/345.1
6,324,725 B1 * 12/2001 Green ..... 16/42 R
6,374,841 B1 * 4/2002 Yamamoto et al. ..... 248/188.9
6,405,982 B1 * 6/2002 Ferencz ..... 248/188.9
6,626,405 B1 * 9/2003 Keast et al. ..... 248/188.9
6,647,589 B1 * 11/2003 Youngwith ..... 248/345.1

* cited by examiner

*Primary Examiner*—Peter R. Brown

(57) ABSTRACT

A protective cover for use on the bottom of chair and table legs. The invention device includes an elastomeric sleeve or cup having a bottom to which is connected a disk of soft, dense and durable protective materials such as felt.

3 Claims, 2 Drawing Sheets

PROTECTIVE COVERS FOR LEGS OF TABLES AND CHAIRS

FIELD OF THE INVENTION

The present invention relates generally to a protective cover for a table or chair leg to prevent the floor from being damaged when the chair or table is being moved relative thereto.

BACKGROUND OF THE INVENTION

To prevent a floor from being damaged when a chair or table is moved various sizes of felt disks or other soft material has been fastened to the bottom of the chair or table legs. The protective materials are usually attached to the furniture legs by a variety of means such as adhesives or mechanical fasteners.

Existing products are not as durable as desired and the adhesives used tend to lose their adhesion ultimately causing the bond to fail. Mechanically connecting the leg covering was not totally dependable and relied on fastening members that could come loose as well as the integrity of the material. In addition, covers often required tools to attach or did not closely fit the leg it was supposed to cover.

The leg covering according to the present invention is a substantial improvement over the prior art by providing a more durable, secure and versatile design.

SUMMARY OF THE INVENTION

In view of the foregoing disadvantages inherent in the known covering for the legs of chairs and tables, the present invention provides a new and unique article that can be securely attached to a wide variety of leg shapes and materials.

The present invention, provides a simple, easily attached, durable cover that can be readily attached and removed from a furniture leg. The portion of the cover in contact with the floor is made of a material such as felt that will not damage the floor when moved relative thereto.

The present invention employs a soft material disk, like felt, that is bonded to an elastomeric cup or sleeve that will be designed to fit over the end of a chair or table leg holding the soft protective material securely in place.

Two embodiments of the invention have been illustrated and described in detail, but it is to be understood that the invention is not limited to such specific embodiments.

The main object of my invention is to provide an article that will protect floor finishes from moving or sliding furniture, such as tables or chairs, by affixing a soft material, like felt, to the bottom of an elastomeric cup or sleeve that fits over the end of a furniture leg.

The article is easy to install and remove without permanently damaging the furniture, but will securely hold the protective material, like felt, in place during movement of the furniture leg.

The novel article can be securely attached to a wide variety of leg sizes, shapes and materials.

The article can be manufactured in various colors and patterns and can serve to also provide a surface for seasonal or artistic decoration.

BRIEF DESCRIPTION OF THE DRAWINGS

The various features and advantage of the invention will become more readily apparent when considered in conjunction with the following drawings in which.

DETAILED DESCRIPTION OF THE INVENTION

Referring first to FIGS. 1–4 there is illustrated a first embodiment of the invention consisting of an elastic sleeve 10 constructed, for example, of a sheet 12 of an elastomeric material such as a neoprene laminate which will fit tightly around the leg of a chair or table. These can be made in a range of sizes to accommodate legs having varying sizes and shapes. The only requirement being that when in place it will elastically adhere to the leg on which it is located.

Figure 1:
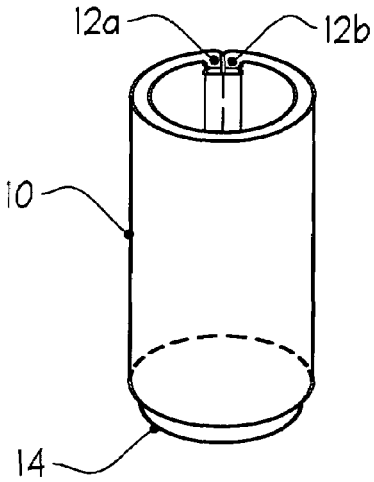
FIG. 1 is a perspective view of an embodiment of the invention comprising a sheet of elastic material made into a sleeve by stitching or connecting the ends by Velcro.
Figure 3:
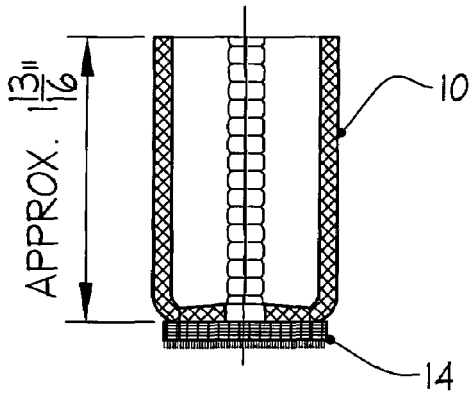
FIG. 3 is a cross-sectional view of the embodiment shown in FIG. 1.
Figure 4:
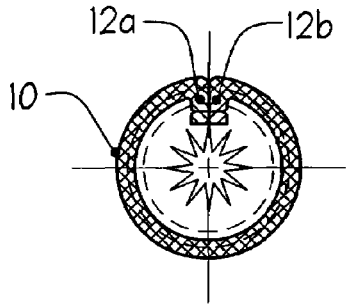
FIG. 4 is a top view of the embodiment shown in FIG. 1.
Figure 2:
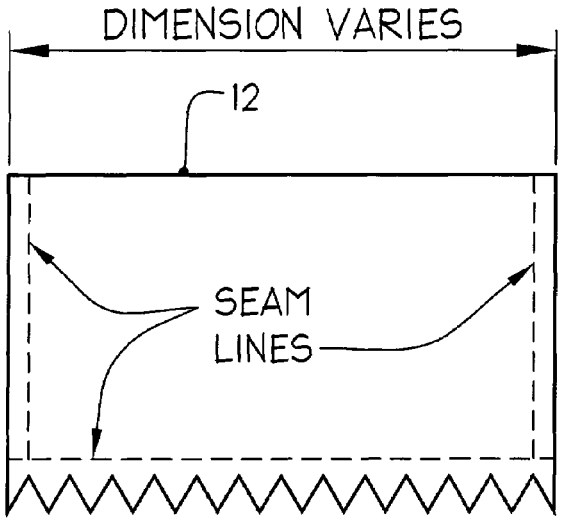
FIG. 2 is a view of one design of a sheet that is used before it is formed into a sleeve.

Secured to the bottom of the sleeve 10 is a felt disk 14 of approximately ¼ thickness, but this thickness is by way of example only. The felt disk 14 is usually stitched or glued to hold it in place. As shown in FIGS. 1–4, a sheet of the elastic material 12 is formed into the sleeve 10 by stitching or a Velcro fastener. Specifically, the ends 12*a*, 12*b* of the sheet are turned inwardly as shown in FIGS. 1 and 4 and connected in this position to form the sleeve 10.

Figure 5:
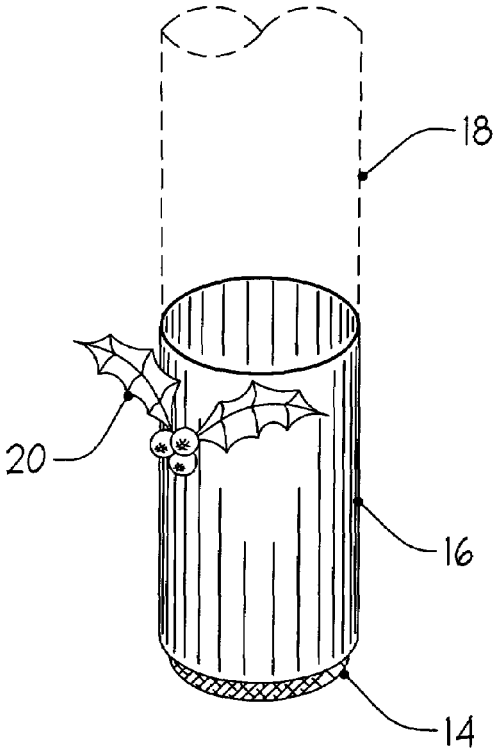
FIG. 5 is a perspective view of a second embodiment of the invention in which the present invention is in the form of a molded cup assembly shown attached to a leg of a chair or table.
Figure 6:
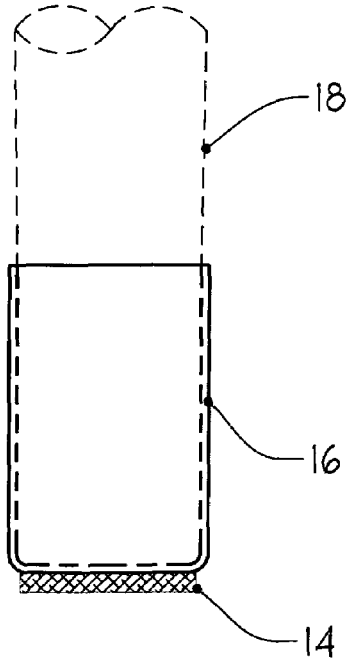
FIG. 6 is a cross-sectional view of the embodiment shown in FIG. 5.

The second embodiment is shown in FIGS. 5 and 6 and consists of a molded cup 16. The cup 16 is shown disposed on a leg 18. The cup 16 could be manufactured from translucent material in a variety of colors or patterns with printed decorations. Secured to the bottom of the cup 16 by an adhesive or other bonding material is a felt disk 14 of the type shown in FIGS. 1 and 4. Specifically, as shown in FIG. 5 the cup 16 could be made of a material to which is attached a three dimensional decoration 20.

It is to be understood that the dimensional relationship for the parts of the invention such as the size, materials and shapes are limitless in their variations and it is intended to encompass all such variables and embodiments that fall within the true spirit and scope of the invention.

What is claimed is:

1. A furniture leg cover assembly to protect a floor from being damaged resulting from movement of a furniture leg relative to the floor, including a soft, elastomeric, conformable sleeve formed of a neoprene laminate material which is closed at a bottom portion to form an upwardly open receptacle having a predetermined circumference, said sleeve being adapted to stretch and expand to fit over furniture legs having a greater circumference than said predetermined circumference of the receptacle, thereby utilizing the prehension properties and characteristics of said neoprene laminate material for tightly gripping the leg and protecting the leg from damage caused by contact with hard objects, said sleeve having a disk made of a dense fibrous protective barrier secured with an adhesive to an outer surface of the sleeve at the closed bottom portion thereof.

2. The leg cover assembly as set forth in claim 1, wherein the elastomeric sleeve is constructed from neoprene laminate material that is rolled to form a cylinder having a seam along the length of the sleeve that is stitched and glued, or molded to form said sleeve.

3. The leg cover assembly as set forth in claim 1 in which the disk is made of felt material.

* * * * *

UNITED STATES PATENT AND TRADEMARK OFFICE

CERTIFICATE OF CORRECTION

PATENT NO. : 7,124,986 B1
APPLICATION NO. : 10/877481
DATED : October 24, 2006
INVENTOR(S) : David M. Bailey It is certified that error appears in the above-identified patent and that said Letters Patent is hereby corrected as shown below:

On the title page, item (75) Inventor should read: --David M. Bailey, 39 Brooklawn Ave., Norwalk, CT (US)06854--
The address is incorrectly show as "30 Brooklawn".

Signed and Sealed this

Twelfth Day of December, 2006

JON W. DUDAS
*Director of the United States Patent and Trademark Office*